US005107934A

United States Patent [19]

Atchison

[11] Patent Number: 5,107,934

[45] Date of Patent: Apr. 28, 1992

[54] PILE DRIVER

[75] Inventor: Ivan Atchison, Alberta, Canada

[73] Assignee: Double "K" Pile Drivers Ltd.

[21] Appl. No.: 664,830

[22] Filed: Mar. 5, 1991

[51] Int. Cl.[5] ..... E21B 49/02

[52] U.S. Cl. ..... 173/128; 173/86

[58] Field of Search ..... 173/81, 84, 86, 89, 173/128

[56] References Cited

U.S. PATENT DOCUMENTS

| | | | |
|---|---|---|---|
| 2,135,970 | 11/1938 | Dukelow | 173/87 |
| 2,470,974 | 5/1949 | Boydstun | 173/87 |
| 2,950,603 | 8/1960 | Macek et al. | 173/87 |
| 3,216,511 | 11/1965 | Ladd et al. | 173/89 |
| 3,447,613 | 6/1969 | Lisenby | 173/86 |
| 3,490,548 | 1/1970 | Lake | 173/86 |
| 4,667,746 | 5/1987 | Moraly | 173/89 |
| 4,993,500 | 2/1991 | Greene et al. | 173/86 |

*Primary Examiner*—Mark Rosenbaum
*Assistant Examiner*—Scott A. Smith
*Attorney, Agent, or Firm*—George H. Dunsmuir

[57] ABSTRACT

A relatively simple pile driver includes a tubular holder with a closed top end and an open bottom end for receiving a pile; a tubular hammer with a closed bottom end and an open top end, the hammer containing lead and being mounted on the holder; four guide rods extending through large plates closing the top end of the holder and the bottom end of the hammer permitting controlled vertical movement of the hammer above the holder, the guide rods extending upwardly to a positioning plate above the hammer; a pair of cables extending upwardly from the plate closing the top end of the holder and through slots in the positioning plate to a bar, which is connected to a crane or other lifting apparatus by another cable for positioning the pile drive; and a pair of hydraulic cylinders extending upwardly from a pair of brackets on the bottom end of the holder, with piston rods extending upwardly from the open top ends of the cylinders to brackets on the hammer above the holder, whereby, the hammer can be raised and, when hydraulic fluid is vented from the cylinders, the hammer is free to fall against the holder to drive a pile into the ground.

2 Claims, 2 Drawing Sheets

PILE DRIVER

BACKGROUND OF THE INVENTION

This invention relates to a pile driver.

More specifically, the present invention relates to a pile driver of the gravity type involving the use of a weighted hammer, which is raised and allowed to drop onto a pile holder.

Pile drivers of the above described type already exist, including manually operated devices in the form of so-called post pounders and fluid cylinder operated drivers, which generate much higher forces. In generally, fluid cylinder devices, e.g. hydraulic cylinder actuated devices are somewhat complicated and consequently expensive to produce. Examples of such pile drivers are described in U.S. Pat. Nos. 2,068,045, issued to J. Wohlmeyer on Jan. 19, 1937; 2,885,862, issued to E. A. Smith on May 12, 1959 and 4,086,968, issued to G. C. Wandell on May 2, 1978. It is readily apparent that a need still exists for a simple, inexpensive mechanical or fluid operated pile driver.

The object of the present invention is to meet the above described need by providing a pile driver, which is relatively simple in terms of both structure and operation.

BRIEF SUMMARY OF THE INVENTION

Accordingly, the present invention relates to a pile driver comprising holder means for receiving one end of a pile; first plate means closing the top end of said holder means; hammer means on said holder means in contact with said first plate means in the rest position; first guide means extending upwardly from said holder means through said hammer means for guiding said hammer means during reciprocation thereof against said first plate means; and fluid actuated cylinder means for elevating said hammer means with respect to said holder means whereby, the holder means can be placed on a pile, and the hammer means elevated and released to fall into contact with said first plate means for driving the pile downwardly.

BRIEF DESCRIPTION OF THE DRAWINGS

The invention will be described in greater detail with reference to the accompanying drawings, which illustrate a preferred embodiment of the invention, and wherein.

DESCRIPTION OF THE PREFERRED EMBODIMENT(S)

Figure 1:
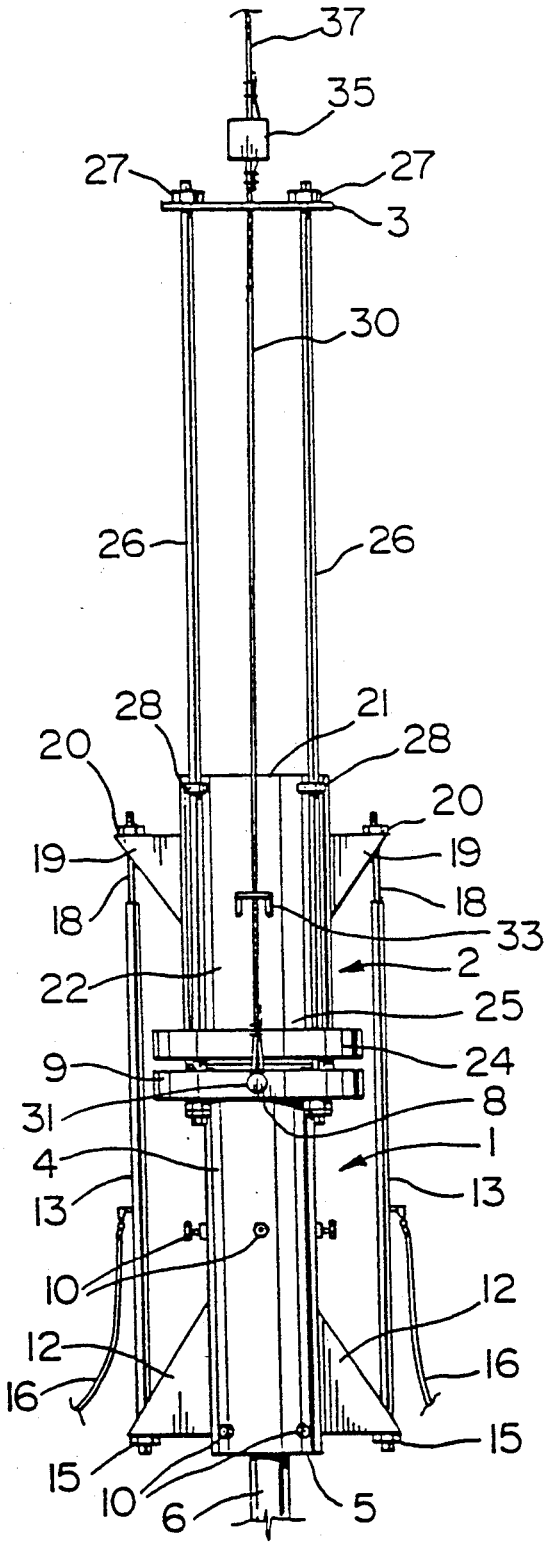
FIG. 1 is a front view of a pile driver in accordance with the present invention.
Figure 2:
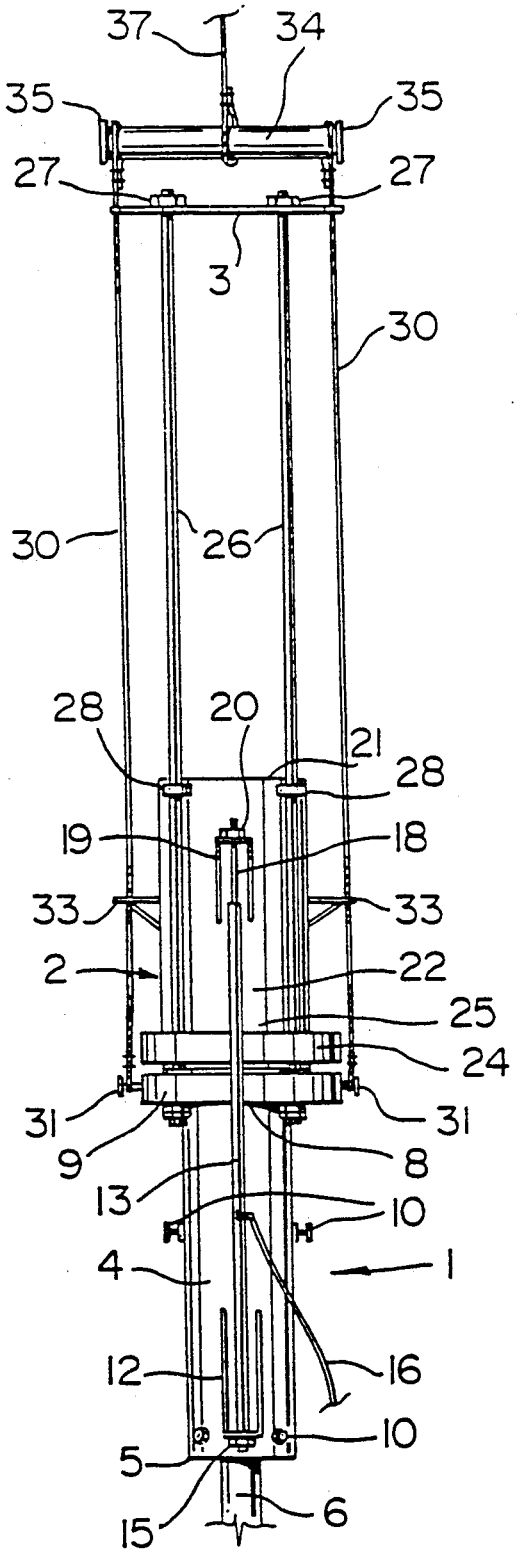
FIG. 2 is a side view of the pile driver of FIG. 1.

With reference to the drawings, the basic elements of the pile driver of the present invention include a pile holder and a hammer generally indicated at 1 and 2, respectively, and a positioning plate 3.

The pile holder 1 is defined by an elongated, cylindrical tube 4 with an open bottom end 5 for receiving a pile 6. The top end 8 of the tube 4 is closed by a thick, circular, metal plate 9. A plurality of bolts 10 are provided in the tube 4 for centering the pile 6 in the holder 1. A pair of triangular brackets 12 of generally U-shaped cross section extend outwardly from opposite sides of the tube 4 near the bottom end thereof. The brackets 12 receive the threaded bottom ends of a pair of hydraulic cylinders 13, which are retained in the brackets 12 by nuts 15. Hydraulic fluid is fed to and discharged from the cylinders 13 via lines 16. Piston rods 18 extend upwardly from the top ends of the cylinders 13 to triangular, inverted U-shaped cross section brackets 19, which are similar to the brackets 12. Nuts 20 are provided on the threaded top ends of the rods 18 for holding the rods in the brackets 19.

The brackets 19 are mounted on the upper end 21 of the tubular, cylindrical body 22 of the hammer 2. A thick, circular metal plate 24 closes the bottom end 25 of the body 22, which is a least partially filled with 1,000 pounds of lead. Four guide rods 26, spaced equidistant apart around the body 22, extend upwardly from the plate 24 to the plate 3. The rods 26 have threaded top ends for receiving nuts 27. Lugs 28 defining rod guides are provided on the body 22 near the top end thereof.

A pair of cables 30 are connected to lugs 31 extending outwardly from opposite sides of the holder top plate 9. The cables 30 extend upwardly through guide loops 33 and the plate 3 to a bar 34. The bar 34 is cylindrical, with square end plates 35 for holding the cables 30 on the bar. A third cable 37 is attached to the bar 34 for connecting the latter to a crane (not shown) or other device for lifting and positioning the pile driver. The plate 3 is hexagonal, and includes generally L-shaped slots 38 at two diametrically opposed vertices for slidably receiving the cables 30.

Figure 3:
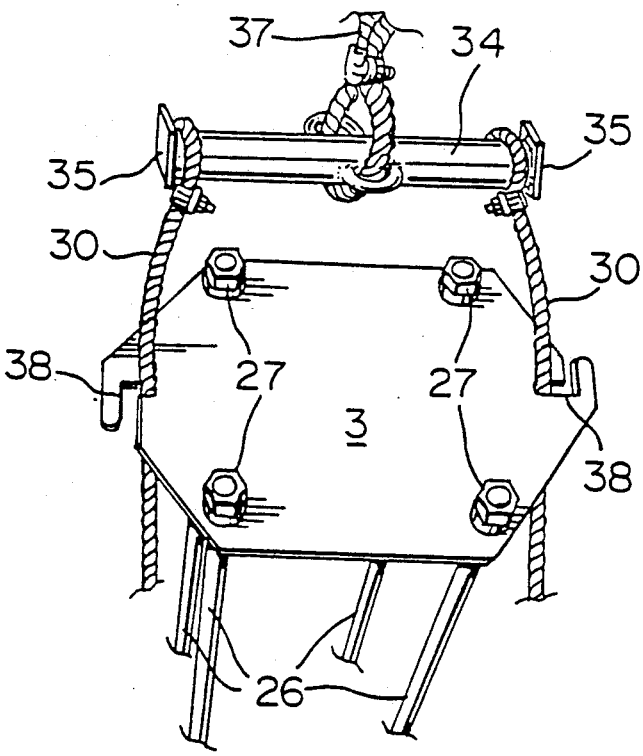
FIG. 3 is an isometric view of a positioning plate used in the device of FIGS. 1 and 2.
Figure 4:
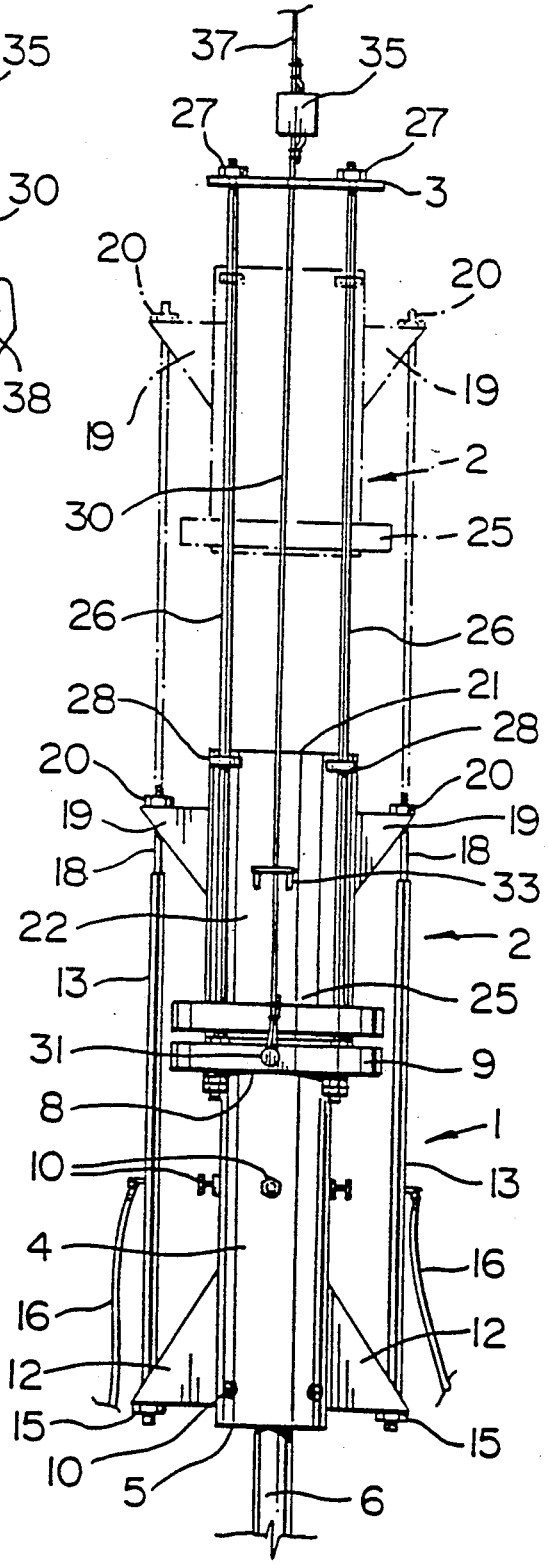
FIG. 4 is a side view of the device of FIGS. 1 and 2, illustrating operation of the pile driver.

It will be appreciated that the pile driver and piles can be laid flat on a truck bed or trailer for transport from location to another. The device is raised from the horizontal, transport position (not shown) to the vertical, use position by connecting the cable 37 to a crane or other lifting apparatus. The cables 30 are inserted into the slots 38 (FIG. 3), and the entire device is lifted. With the pile holder, vertically oriented, a pair 6 is placed therein. The pile 6 is centered in the holder tube 4 using the bolts 10. Of course, it will normally be necessary to adjust the nuts once if the piles 6 are of one diameter only. Once the pile 6 has been properly positioned and has started to enter the ground, the cable 37 is allowed a reasonable amount of slack so that the hammer 2 is not working against the cables 30 and 37. The piston rods 18 are extended to move the hammer 2 upwardly to an elevated position (shown in phantom outline in FIG. 4). During vertical movement relative to the holder 1, the hammer 2 is guided by the rods 26. When hydraulic fluid is vented from the cylinders 13 to the usual reservoir (now shown), the hammer 2 falls against the pile holder 1 to drive the pile 6 into the ground.

Thus, there has been described a fluid operated pile driver which is structurally simple and easy to use.

What is claimed is:

1. A pile driver comprising holder means for receiving one end of a pile; hook means on said holder means for receiving one end of a first cable for lifting the pile driver for transportation or locating on a pile, said holder means further including an elongated tube having bolts extending transversely therethrough for centering a pile within said holder means; first plate means closing a top end of said holder means; hammer means on said holder means in contact with said first plate means in a rest position; guide means comprising rod means, extending upwardly from opposite sides of said holder means through said hammer means for guiding said hammer means during reciprocation thereof against said first plate means; second plate means at the bottom end of said hammer means for contacting said first plate means; said first and second plate means extending outwardly from said holder means and hammer means for receiving one end of said guide means, said rod means extending through said first and second plate means; a positioning plate at a top end of said guide means above said hammer means, and fluid actuated cylinder means for elevating said hammer means with respect to said holder means, said cylinder means including a pair of diametrically opposed hydraulic cylinders mounted proximate a bottom end of said holder means; and piston rods extending upwardly from said cylinders and connected to said hammer means proximate a top end thereof, whereby, the holder means can be placed on a pile, and the hammer means elevated and released to fall into contact with said first plate means for driving the pile downwardly.

2. A pile driver according to claim 1 including slots in opposite sides of said positioning plate, second and third cables extending upwardly from said first plate means and through said slots; a bar for carrying said second and third cables; said first cable being also connected to said bar for connecting the pile driver to a lifting device.

* * * * *